US006779674B1

(12) United States Patent
Ayres

(10) Patent No.: US 6,779,674 B1
(45) Date of Patent: Aug. 24, 2004

(54) DISPOSABLE BARRIER FOR A LABORATORY SPLASH PAN

(76) Inventor: Randall W. Ayres, 3376 Boundary St., San Diego, CA (US) 92104

( * ) Notice: Subject to any disclaimer, the term of this patent is extended or adjusted under 35 U.S.C. 154(b) by 43 days.

(21) Appl. No.: 09/710,723

(22) Filed: Nov. 10, 2000

(51) Int. Cl.[7] ..... B65D 21/02
(52) U.S. Cl. ..... 220/23.87
(58) Field of Search ..... 220/495.01, 495.03, 220/23.9, 23.87

(56) References Cited

U.S. PATENT DOCUMENTS

| | | | | | |
|---|---|---|---|---|---|
| 1,965,138 | A | * | 7/1934 | Dunlap | 47/11 |
| 1,987,020 | A | | 1/1935 | Looft | |
| 2,147,805 | A | | 2/1939 | Windsor | |
| 2,287,495 | A | * | 6/1942 | Moyers | 220/495.03 |
| 2,817,851 | A | | 12/1957 | Barnwell | |
| 3,249,070 | A | * | 5/1966 | Day et al. | 220/495.01 X |
| 3,430,803 | A | * | 3/1969 | Nelson | 220/495.03 X |
| 3,698,594 | A | * | 10/1972 | Boehlert | 220/495.01 |
| 3,992,730 | A | | 11/1976 | Davis | |
| 4,336,620 | A | | 6/1982 | Gresh | |
| 4,419,774 | A | | 12/1983 | Hajek | |
| 5,012,537 | A | | 5/1991 | Underwood | |
| 5,815,856 | A | | 10/1998 | Dore | |
| 6,076,693 | A | * | 6/2000 | Reiter et al. | 220/9.1 |
| 6,305,567 | B1 | * | 10/2001 | Sulpizio | 220/495.11 |

* cited by examiner

*Primary Examiner*—Joseph Man-Fu Moy
(74) *Attorney, Agent, or Firm*—Higgs, Fletcher & Mack LLP; Charles F. Reidelbach, Jr.

(57) ABSTRACT

A disposable barrier for a laboratory splash pan made of a non-porous yet durable material, form fitted to fit snugly within the interior surface of a laboratory splash pan, so as to avoid the need to autoclave or disinfect such pans after each use. A reservoir is formed within the base of the insert to provide a convenient means to store cleaning or polishing agents, such as pumice, within the insert. Flaps extend from the base of the insert to protect the elevated perimeter of the splash pan, and assist in securing the insert within the splash pan. Side and back walls project upward from the insert to protect and shield corresponding side and back walls of the splash pan. A top panel may be utilized to protect the interior surface of an overhanging canopy present in some splash pans.

9 Claims, 2 Drawing Sheets

DISPOSABLE BARRIER FOR A LABORATORY SPLASH PAN

FIELD OF THE INVENTION

This invention relates to barriers of infectious agents, and more specifically, to a disposable laboratory splash pan insert having a nonporous and rigid surface.

BACKGROUND OF THE INVENTION

The control of infectious agents is a constant concern for all health care professionals. Health care professionals, such as physicians and dentists, are exposed to a vast array of microorganisms and other infectious agents in the bodily fluids of patients. The need to control the spread of such contaminants to fellow health care workers or patients is paramount.

Accordingly, various techniques have been developed to keep the work environment and patient interaction areas free from infectious microorganisms, including bacteria and viruses. In recent years, the Operational Safety and Health Administration (OSHA) has been mandated by the United States Congress to implement procedures and requirements in the workplace to protect employees from exposure to blood borne pathogens. In a similar effort, the American Dental Association has issued recommendations to help control occupational transmission of infectious disease. One such recommendation states that ragwheels and laboratory splash pans, commonly used to clean and polish denture fixtures, be autoclaved or disinfected after each use. Autoclaving is a process used in the art for steam sterilization of equipment or materials. Alternate autoclaving processes utilize chemical reactions at high temperature and under pressure. Such a process requires the use of a strong steel vessel to carry out the autoclave process and can be quite time consuming. Additionally, the expense of purchasing or utilizing an autoclave can be significant. As a result, many technicians often forgo utilizing the time intensive autoclave process, and may simply wipe down the equipment with a common disinfectant. However, the elimination of many infectious agents is only possible when done under high heat, as in an autoclave.

Laboratory splash pans are often used by such health care professionals as dentists to clean and polish dentures. The dentist typically places the denture within the pan, and using a polishing agent such as pumice, polishes or cleans the denture. The splash pan is utilized to keep the surrounding surface free of debris and microorganisms typically released during such a process. According to the recommendations of the American Dental Association, the splash pan should be autoclaved or otherwise disinfected after each cleaning or polishing, so as to reduce the risk of passing on infectious agents to the dentist or subsequent denture wearers. Such a process, although effective in reducing the risk of transmitting infectious agents, is inefficient and relatively expensive. Consequently, the autoclaving process may often times be omitted, increasing the likelihood of passing on infectious agents. There is therefore a need for a time efficient and cost effective means to prevent the spread of infectious agents during the utilization of laboratory splash pans.

The present invention addresses these and other problems.

SUMMARY OF TH INVENTION

The present invention provides a device for preventing the transmission of infectious microorganisms to a laboratory splash pan, and consequently from patient to patient, often utilized to clean or polish prosthetics carrying such infectious microorganisms. The device utilizes a disposable insert having the general shape of the interior surface of a laboratory splash pan, so as to allow the insert to fit snugly within the splash pan. Flaps extending from the base of the insert are designed so as to fold over the elevated lip of the splash pan, providing a means to protect the lip of the splash pan, and also assisting in securing the insert within the splash pan.

In accordance with one aspect of the invention, side walls project upward from a distal portion of the insert, so as to protect corresponding side walls of the splash pan. Similarly, a back wall may also project from the base of the insert, so as to protect a corresponding back wall on the splash pan. Additionally, a top surface may be included to protect an overhanging canopy present in some splash pans.

In accordance with another aspect of the invention, a sealable reservoir may be included within the base of the insert to retain polishing or cleaning agents, such as pumice, commonly used when dental prosthetics are cleaned in such splash pans. The inclusion of a reservoir necessitates that the base of the insert be of a thickness sufficient to provide room for the reservoir to be formed and still provide protection for the splash pan.

It is therefore an object of this invention to provide an inexpensive and time efficient means to protect patients and health care workers from the spread of infectious microorganisms during the use of laboratory splash pans.

It is a further object of this invention to provide adequate protection against the spread of infectious agents during the repetitive use of laboratory splash pans, without necessitating the use of an autoclave after each use of the splash pan.

It is yet another object of this invention to provide a convenient means to access polishing or cleaning agents when utilizing a laboratory splash pan, without bringing surrounding surface areas into contact with infectious microorganisms.

The foregoing has outlined some of the more pertinent objects of the present invention. These objects should be construed to be merely illustrative of some of the more prominent features and applications of the invention. Many other beneficial results can be attained by applying the disclosed invention in a different manner or by modifying the invention as will be described. Accordingly, other objects and a fuller understanding of the invention may be had by referring to the following Detailed Description of the Invention, which includes the preferred embodiment.

BRIEF DESCRIPTION OF THE DRAWINGS

These and other features and advantages of the invention will now be described with reference to the drawings of certain preferred embodiments, which are intended to illustrate and not to limit the invention, and in which.

DETAILED DESCRIPTION OF THE INVENTION

The present invention provides a disposable barrier for protection of laboratory splash pans from contamination of infectious microorganisms.

Figure 1:
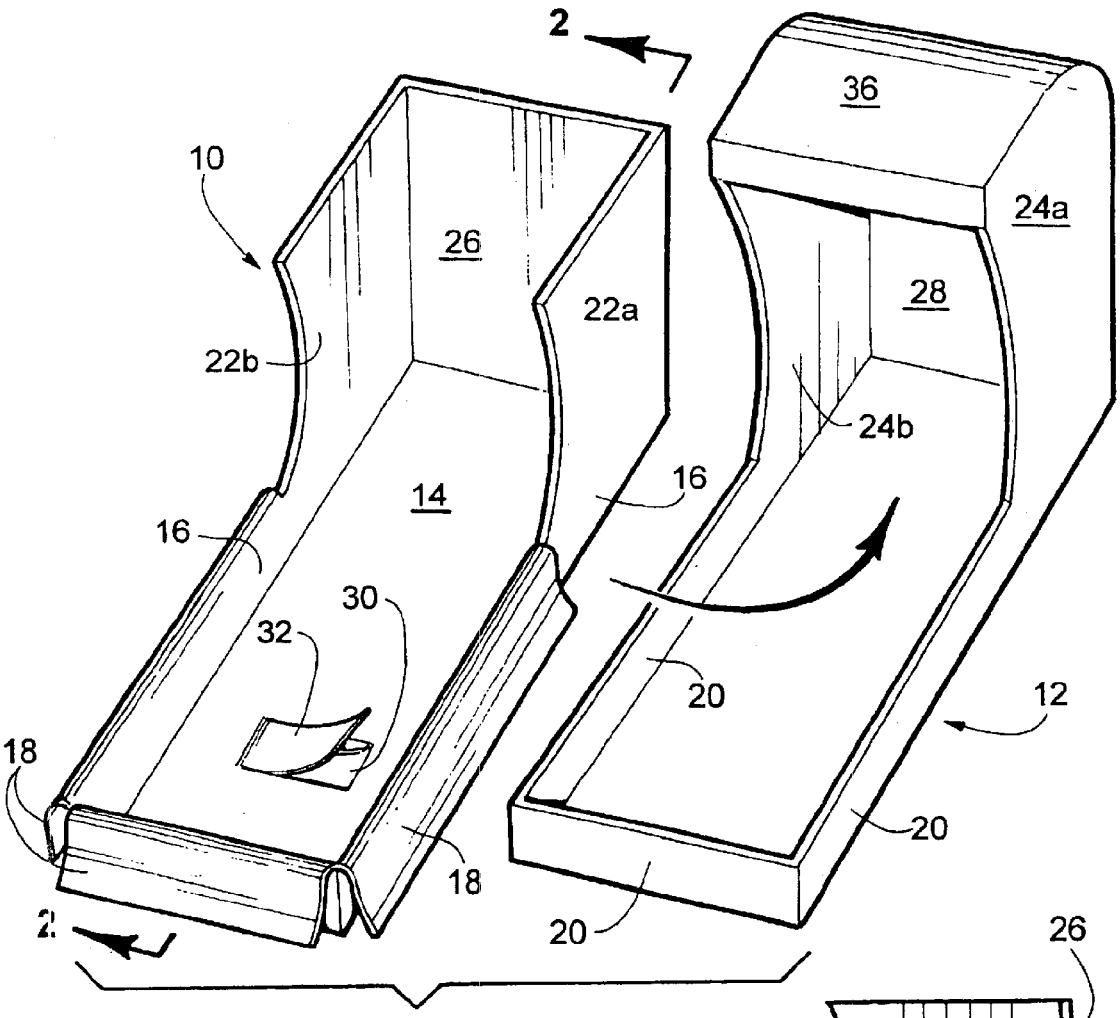
FIG. 1 is an exploded perspective view of a laboratory splash pan insert as utilized with a standard laboratory splash pan in accordance with the teachings of the present invention.

Referring now to FIG. 1 in particular there is shown a perspective view of a splash pan insert 10 as used to protect a laboratory splash pan 12 from the spread of infectious microorganisms. The splash pan insert 10 is of a size and shape customized to fit snugly against the interior surface of a laboratory splash pan 12. The general size and shape of the insert 10 will vary according to the specified splash pan it is to be utilized with. The splash pan 12 depicted is a splash pan commonly utilized in dental laboratories for cleaning or polishing dentures. Such a splash pan is commonly sold under the trademark known as "Almore," manufactured by Sullivan-Shein. It is to be understood however, that the present invention may be altered in shape to fit a wide array of splash pans, or similar articles that may necessitate a disposable barrier from infectious microorganisms.

The splash pan insert 10 includes a base 14 that forms a tray having an elevated perimeter 16 that extends the full perimeter of the base 14. The relative height of the elevated perimeter 16 is preferably in the range of about 2.5 centimeters to 4 centimeters, but it is to be understood that this dimension may vary to fit variations in size of various splash pans. Flaps 18 extend from the perimeter 16 so as to fold over and protect the elevated lip 20 of the splash pan 12 when the insert 10 is placed within the interior of the splash pan 12. The flaps 18 are preferably of a dimension equivalent to that of the elevated perimeter 16, so as to substantially cover the elevated lip 20 of the splash pan. Side panels 22*a,b* project upward from the base 14 to protect corresponding side walls 24*a,b* of the splash pan 12. The side panels 22*a,b* are typically located towards the distal, or rearward, portion of the base 14, so as to allow ease of accessibility to the opening of the splash pan 12, which is proximal to the user. A back wall 26 projects upward from the base 14 to protect a corresponding back wall 28 of the splash pan 12, and as with the side panels 22*a,b* is located distal to the user. The height of the back wall 26 and side panels 22*a,b* are preferably in the range of about 14 centimeters to 30 centimeters, such that they cover a substantial portion of corresponding walls and panels on a variety of splash pans.

A reservoir 30 is positioned within the base 14 to provide a basin in which to hold cleansing or polishing material typically used in the laboratory, such as pumice for example. A removable cover 32 is placed over the reservoir 30 in order to protect and secure the material within the reservoir 30. It should be understood however, that the reservoir 30 is provided as an additional feature to the invention, for convenience of the user when utilizing polishing or cleaning agents. Alternate embodiments (not shown) may be constructed that do not contain a reservoir 30 within the base 14.

Figure 2:
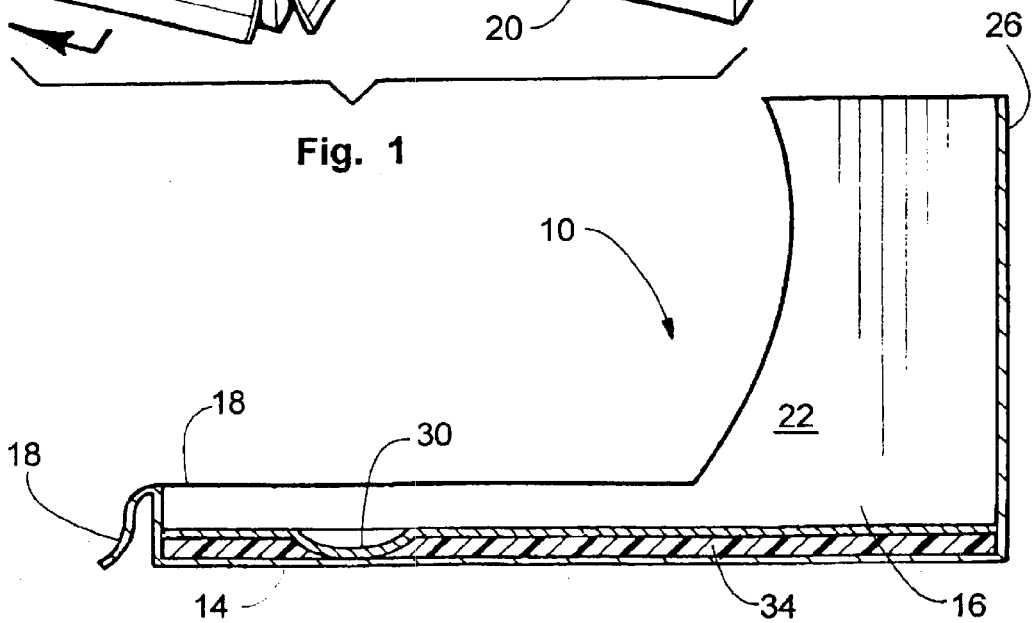
FIG. 2 is a cross-sectional view of a laboratory splash pan insert constructed in accordance with the teachings of the present invention.
Figure 3:
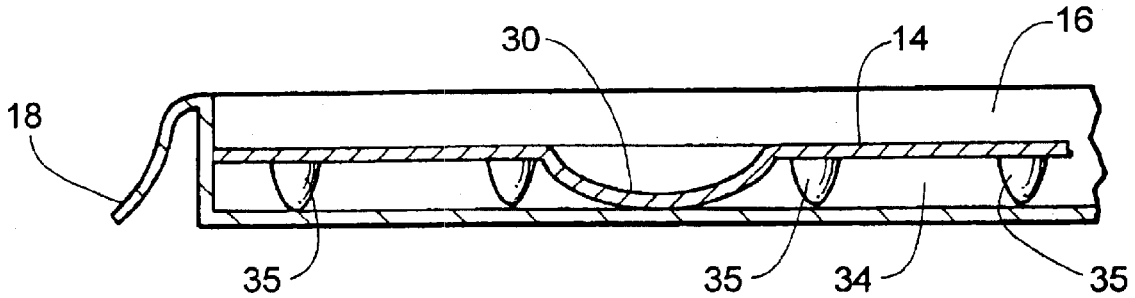
FIG. 3 is a cross-sectional view of the base of an alternate embodiment of a splash pan insert constructed in accordance with the teachings of the present invention.

The reservoir is formed within the base 14, and as shown in the cross sectional view illustrated in FIG. 2 is integral with the base 14. The base 14 is of a thickness 34 so as to accommodate the depth necessary of the reservoir 30 while also maintaining protection for the splash pan 12 directly beneath the reservoir 30. The thickness 34 of the base 14 is in the range of about 2.0 millimeters to about 2.0 centimeters, but is preferably about 1.5 centimeters, such that it does not rise greater than halfway up the elevated lip 20 of the splash pan 12. Alternatively, the base 14 may be elevated a distance equivalent to the thickness 34 of the preferred embodiment by supports 35, such as ridges or an elevated grid, positioned throughout the underside of the base 14, as illustrated in FIG. 3. Although the integral formation of the reservoir 30 within the base 14 is preferred to avoid potential leakage, the reservoir 30 may be removable from a cavity within the base 14 in alternate embodiments (not shown). It is to be understood that in embodiments not utilizing a reservoir, the base may be of a minimal thickness, similar to that of the side panels 22*a,b* and back wall 26, but is preferably in the range of about 0.1 centimeters and 1.0 centimeters.

Figure 4:
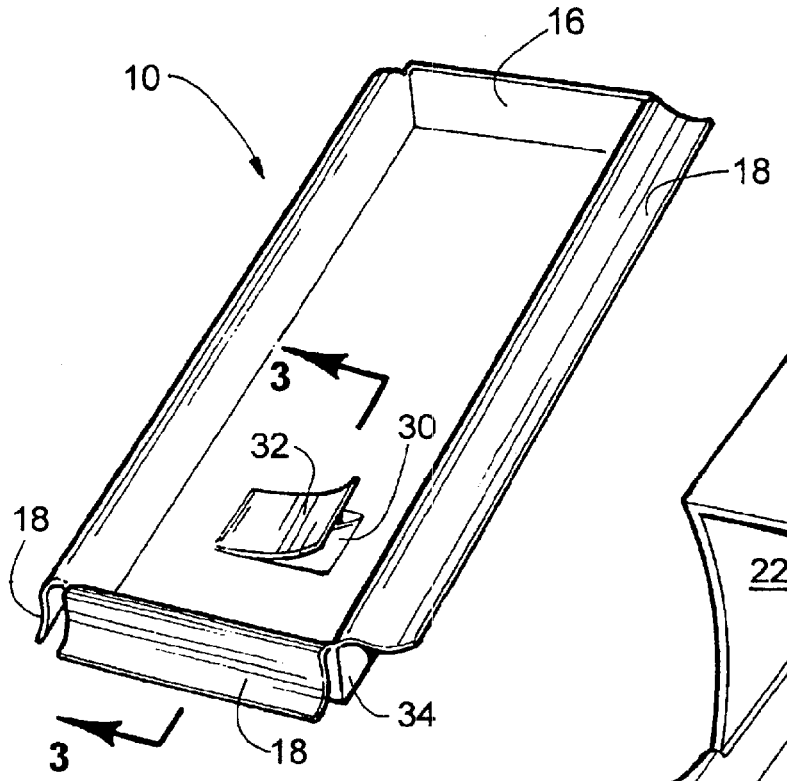
FIG. 4 is a perspective view of an alternate embodiment of a splash pan insert constructed in accordance with the teachings of the present invention, wherein no side panels or back wall are required.

An alternate embodiment, as depicted in FIG. 4, may be utilized wherein protection of side walls and back walls of a splash pan are not required, such as in splash pans that are not constructed with projecting side or back walls. In such an embodiment, the flaps 18 encompass the entire perimeter of the splash pan.

Figure 5:
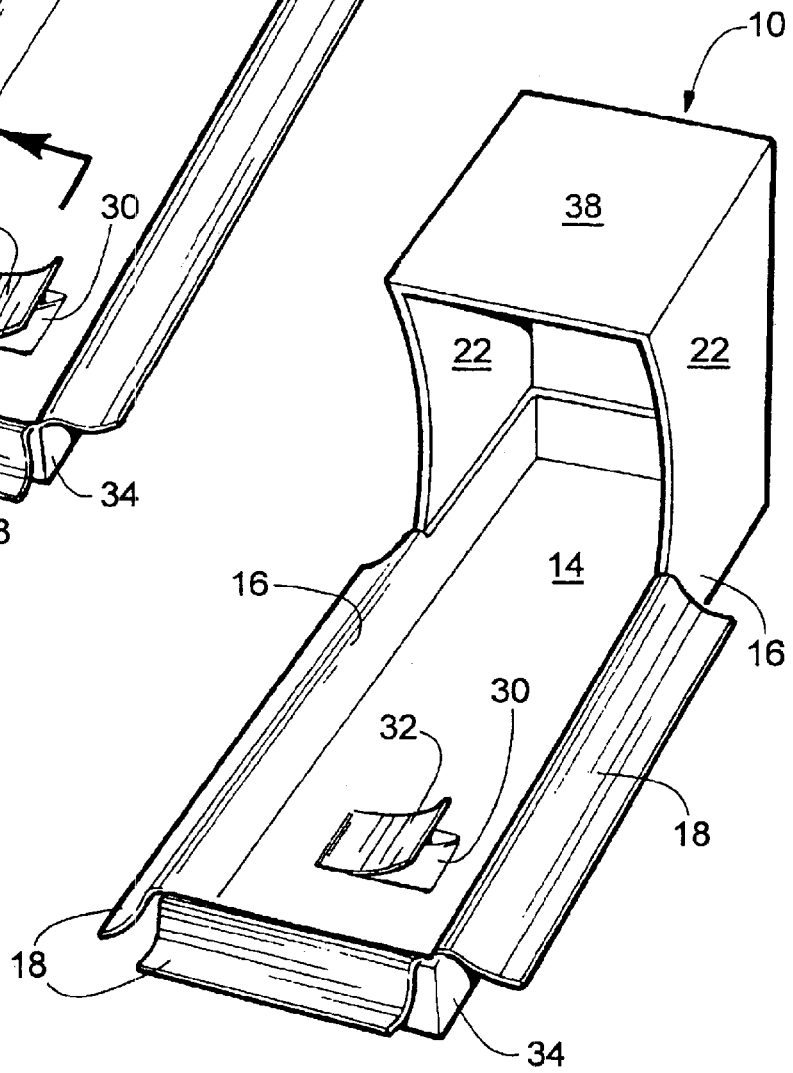
FIG. 5 is a perspective view of an alternate embodiment of a splash pan insert constructed in accordance with the teachings of the present invention, wherein a top panel is further utilized.

An additional embodiment, as illustrated in FIG. 5 may be constructed where it is desirable to protect the interior surface of an overhanging canopy 36 (shown in FIG. 1) that may be present in some splash pans. In such an embodiment, a top panel 38 is formed with the side panels 22 and back wall 26.

The composition of the insert 10 is of a material capable of preventing infectious microorganisms from penetrating through to the splash pan 12. Additionally, it is preferable that the material be easily and inexpensively manufactured so as to facilitate the disposable nature of the invention. It is thus preferable that the insert 10 be made of a non-porous durable plastic material. In the alternative, the insert 10 may be constructed of a durable material, such as cardboard, that is lined with a non-porous material such as wax paper or a plastic membrane.

While the invention has been described herein with reference to certain preferred embodiments, these embodiments have been presented by way of example only, and not to limit the scope of the invention. Accordingly, the scope of the invention should be identified only in accordance with the claims that follow.

What is claimed is:

1. A disposable barrier for a laboratory splash pan having a tray-like base, a raised closed end portion, and an elevated lip, comprising:

a non-porous rigid disposable insert, having a tray-like base, a raised end portion, wherein said portion encompasses a back wall and sections of two side panels contiguous with said back wall, and an elevated lip, shaped to provide protection to the interior surface of both the tray-like base and the raised closed end portion of the laboratory splash pan; and, an extended perimeter means formed in said insert for overlying and protecting the elevated lip of the laboratory splash pan.

2. A disposable barrier as recited in claim 1, wherein said extended perimeter means includes a foldable flap extending around a perimeter of the tray-like base, so as to be folded over the elevated lip of a splash pan.

3. A disposable barrier for a laboratory splash pan having a tray-like base, a raised closed end portion, and an elevated lip, comprising:

a non-porous rigid disposable insert, having a tray-like base, a raised end portion, wherein said portion encompasses a back wall and sections of two side panels contiguous with said back wall, and an elevated lip, shaped to provide protection to the interior surface of both the tray-like base and the raised closed end portion of the laboratory splash pan;

an extended perimeter means formed in said insert for overlying and protecting the elevated lip of the laboratory splash pan; and, a reservoir formed within said insert for retention of a substance.

4. The disposable barrier of claim 3 wherein said reservoir is integrally formed within a bottom surface of said insert.

5. The disposable barrier of claim 3 further comprising a removable cover to secure a substance within said reservoir.

6. A disposable barrier for a laboratory splash pan having a tray-like base, a raised enclosed canopy, and an elevated lip, comprising:

a non-porous rigid disposable insert, having a tray-like base, a raised end portion, wherein said portion encompasses a back wall and sections of two side panels contiguous with said back wall, and an elevated lip, shaped to provide protection to the interior surface of both the tray-like base and the raised enclosed canopy of the laboratory splash pan; and, an extended perimeter means formed in said insert for overlying and protecting the elevated lip of the laboratory splash pan.

7. The disposable barrier of claim 6 further comprising a reservoir formed within said insert.

8. The disposable barrier of claim 6 wherein said reservoir is integrally formed within a bottom surface of said insert.

9. The disposable barrier of claim 6 further comprising a removable cover to secure a substance within said reservoir.

* * * * *